US012066220B2

(12) United States Patent
Razumtseva et al.

(10) Patent No.: US 12,066,220 B2
(45) Date of Patent: Aug. 20, 2024

(54) REFRIGERATION UNIT WITH DYNAMIC AIR COOLING AND A WORKING ELEMENT OF THE UNIT

(71) Applicant: DAC Sp. z o.o., Elblag (PL)

(72) Inventors: Olha Razumtseva, Kiev (UA); Oleksandr Razumtsev, Kiev (UA); Pavel Panasjuk, Prague (CZ)

(73) Assignee: DAC SP. Z O.O., Elblag (PL)

( * ) Notice: Subject to any disclaimer, the term of this patent is extended or adjusted under 35 U.S.C. 154(b) by 96 days.

(21) Appl. No.: 17/759,848

(22) PCT Filed: Jan. 27, 2021

(86) PCT No.: PCT/IB2021/050606
§ 371 (c)(1),
(2) Date: Jul. 29, 2022

(87) PCT Pub. No.: WO2021/152464
PCT Pub. Date: Aug. 5, 2021

(65) Prior Publication Data

US 2023/0129766 A1 Apr. 27, 2023

(30) Foreign Application Priority Data

Jan. 31, 2020 (PL) ..... P.432791

(51) Int. Cl.
*F25B 11/04* (2006.01)
*F25B 1/053* (2006.01)
*F25B 9/00* (2006.01)

(52) U.S. Cl.
CPC ..... *F25B 11/04* (2013.01); *F25B 1/053* (2013.01); *F25B 9/004* (2013.01)

(58) Field of Classification Search
CPC ..... F25B 11/04; F25B 1/053; F25B 9/004; F25B 25/005; F25B 41/40
(Continued)

(56) References Cited

U.S. PATENT DOCUMENTS 5,271,427 A 12/1993 Berchem
6,360,557 B1 * 3/2002 Reznik ..... B60H 1/32 62/401
(Continued)

FOREIGN PATENT DOCUMENTS

CN 1410732 A 4/2002
CZ 30873 U1 8/2017
(Continued)

OTHER PUBLICATIONS

International Search Report and Written Opinion received for International Application No. PCT/IB2021/050606 mailed on Jul. 29, 2021, 3 Pages.

*Primary Examiner* — Steve S Tanenbaum
(74) *Attorney, Agent, or Firm* — Cherskov Flaynik & Gurda, LLC

(57) ABSTRACT

A refrigeration unit with dynamic air cooling is described. It includes a centrifugal compressor with an electric drive, whose outlet is connected to a working element, whose outlet is connected to the inlet of a turbine. The turbine is connected to an electrical energy generator, where the outlet of the turbine is directed towards a wall-pipe heat exchanger. The heat exchanger is connected to a pump. Between the centrifugal compressor and the working element there is a pipe-wall exchanger of the air-air type, to which a fan is connected. The working element of the unit has a cylindrical hollow profile comprising helical recesses with a substantially oval shape.

10 Claims, 2 Drawing Sheets

(58) Field of Classification Search
USPC ..... 62/56
See application file for complete search history.

(56) References Cited

U.S. PATENT DOCUMENTS

| | | | | |
|---|---|---|---|---|
| 2009/0260388 | A1 | 10/2009 | Nakazeki et al. | |
| 2017/0254223 | A1* | 9/2017 | Goethals | F01K 25/08 |

FOREIGN PATENT DOCUMENTS

| | | | |
|---|---|---|---|
| EP | 1122503 | A1 | 8/2001 |
| GB | 2417760 | A | 3/2006 |

* cited by examiner

REFRIGERATION UNIT WITH DYNAMIC AIR COOLING AND A WORKING ELEMENT OF THE UNIT

TECHNICAL FIELD

The object of the invention is a refrigeration unit for technological fluids, for example water, in home and industrial cooling and air conditioning systems, as well as for a wide range of technological processes: from the cooling of nuclear reactors to pisciculture under artificial conditions. The object of the invention is also a working element of the unit.

BACKGROUND ART

There are known cooling systems for process fluids using the operating principle of vapour compression, the principles of absorption and based on natural exchange of heat with the surroundings.

In the case of systems using the operating principle of vapour compression, their drawback involves the use of an intermediate working fluid, meaning an artificial cooling agent (chlorofluorocarbon), which causes the greenhouse effect;

In the case of absorption systems, drawbacks include large geometric dimensions, high consumption of metal and low cooling capacity.

On the other hand, in the case of natural heat exchange, the so-called "free cooling", the resulting capacity is low and emissions of thermal energy occur. Moreover, it is required to place the devices in the atmosphere under the conditions of low temperature and vast supply of water.

In background art, from the Czech utility model CZ 30873 U1 there is a known cooling device, a dynamic air refrigeration unit comprising an electric centrifugal compressor, where the outlet pipe of the centrifugal compressor is connected to the inlet pipe of a special profiled channel, from which the flow of cooled air with high kinetic energy is directed to the inlet of a radial axial turbine with an electric generator.

This prototype device is disadvantageous in that the air flow behind the centrifugal compressor is delivered directly to the inlet pipe of the working element, which reduces the cooling capacity due to the supply of air to the working element with a temperature higher than the ambient temperature.

It is the purpose of the invention to eliminate these drawbacks and develop a comfortable, environmentally friendly and energy-efficient device for cooling process fluids without the use of artificial cooling agents, which would provide the lack of emission of greenhouse gases, higher energy efficiency and reliability.

DISCLOSURE OF INVENTION

The invention constitutes a refrigeration unit with dynamic air cooling, consisting of a centrifugal compressor with an electric drive, whose outlet is connected to a working element with a cylindrical hollow profile comprising spiral recesses with a substantially oval shape, whose outlet is connected to the inlet of a turbine with a radial axis connected to an electrical energy generator. The outlet of the turbine is directed towards a wall-pipe heat exchanger further connected to a process fluid pump. The essence of the invention is in that, in an arrangement between the centrifugal compressor and the working element, there is a pipe-wall exchanger with a fan connected thereto.

Preferably, an inverter is connected to the generator of the turbine with a radial axis.

Preferably, said inverter is connected to the electric drive of the centrifugal compressor.

The essence of the invention also constitutes a working element of the refrigeration unit, characterised by having a circular inlet; behind the inlet, there is a cylindrical segment with a length substantially shorter than the diameter of the clearance of its opening;

behind the segment, there is a protuberance, whose walls are convex towards the outside and have a semicircular shape, the diameter of the protuberance being larger than the diameter of the cylindrical segment; behind the protuberance, there is a substantially longest segment, shaped in such a way that its inner walls have circumferential recesses with shapes resembling oval, which extend helically along its lengthwise cross-section, the cross-section of the recesses not being uniform along this part of the working element, and the size of this cross-section increasing and decreasing in a fluid manner; behind the segment, there is an outlet with obliquely shaped walls, where a larger diameter is placed at the end of the working element; the recesses become reduced to the area of the outlet.

A refrigeration unit with dynamic air cooling is a cogenerative element, in which cooling is accompanied by the generation of mechanical energy, subsequently converted into electrical energy. Electrical energy can serve as energy recovered to power the device according to the invention itself, partially limiting the intake of electrical energy from outside the system. In contrast to known units, in which heat is released into the atmosphere, in the unit according to the invention there is no emission of heat into the atmosphere, whereas thermal energy is converted into mechanical energy. Such utilisation of the energy provides a very large economic effect, and it is almost neutral to the environment.

BRIEF DESCRIPTION OF DRAWINGS

An embodiment of the invention is presented in the drawing, where.

BEST MODE FOR CARRYING OUT THE INVENTION

Figure 1:
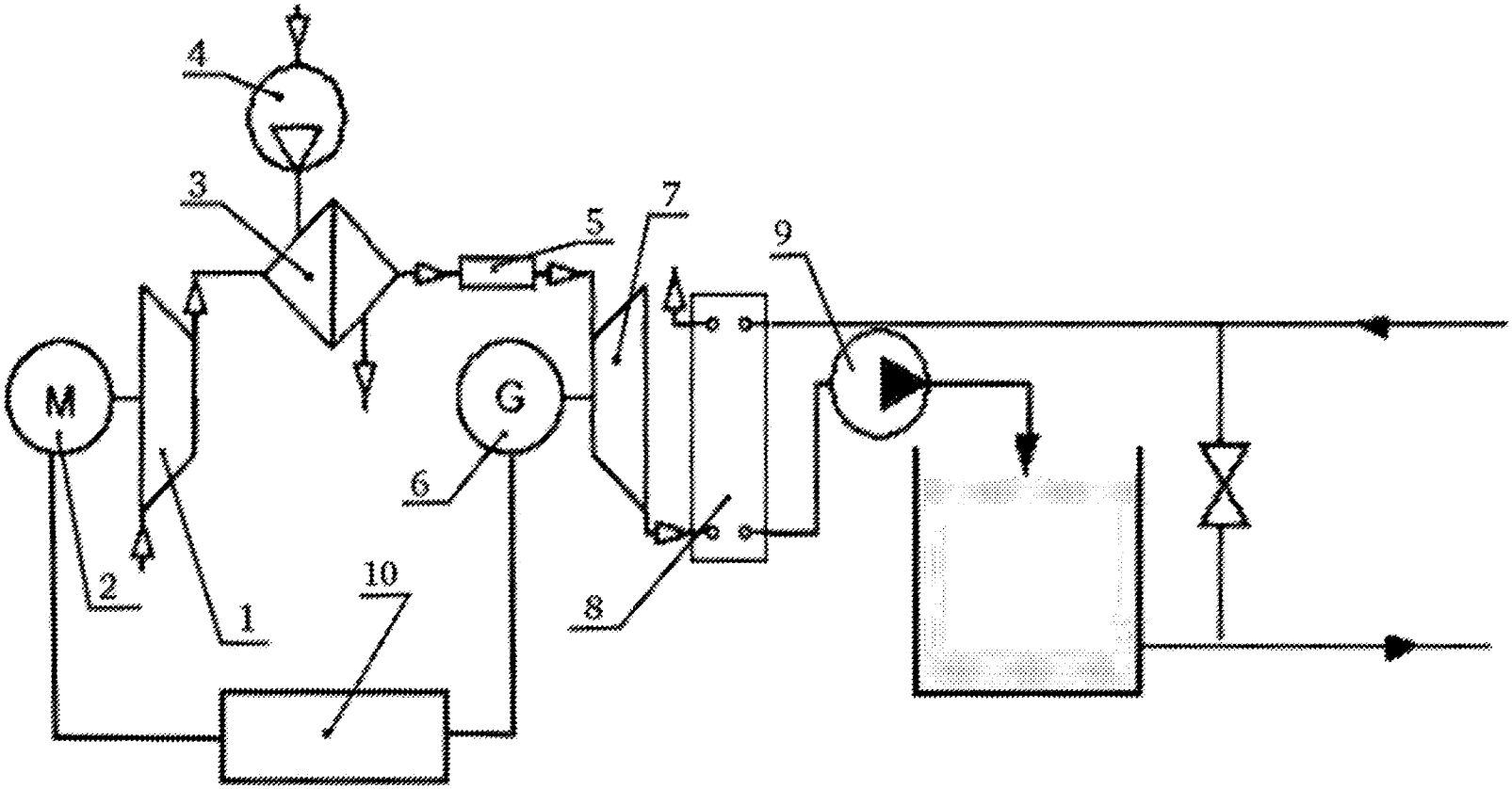
FIG. 1 presents a layout of the arrangement of the device in the form of a unit with dynamic air cooling.

The refrigeration unit with dynamic air cooling in an embodiment consists of a centrifugal compressor 1 with an electric drive 2. The outlet pipe of the centrifugal compressor 1 is connected to the inlet pipe of a pipe-plate heat exchanger 3 connected to a fan 4. The exchanger 3 is an exchanger of the air-air type. The outlet pipe of the pipe-plate heat exchanger 3 is connected to the inlet pipe of a working element 5. The working element 5 is connected to the inlet pipe of a turbine 7 with a radial axis connected to a generator of electrical energy 6. The outlet pipe of the turbine 7 is directed towards a pipe-plate heat exchanger 8 connected to a pump 9. The exchanger 8 constitutes an exchanger of the air-water type. The generator 6 is further connected to an inverter 10. Frequency conversion of the generated electrical energy and its synchronisation with the frequency of the mains power supply take place in the inverter 10.

In an embodiment, the device operates in such a manner that the electric centrifugal compressor 1 powered by the electric drive 2 draws in an ambient air and generates an air stream directed into the inlet pipe of the pipe-plate heat exchanger 3, where the temperature of the air stream is equalised with that of the atmosphere. The air stream is then directed into the inlet pipe of the working element 5. In the working element 5, which constitutes a channel with a special profile described in the following part, a portion of the internal energy of the air is converted into kinetic energy of the air stream, resulting in its cooling. The parameters of the centrifugal compressor 1 are selected based on requirements involving the technical properties of the unit with dynamic air cooling. The profile of the working element 5 is calculated and designed based on the developed mathematical model of the gas dynamics process, based on requirements involving the technical properties of the unit with dynamic air cooling. Subsequently, the stream of cooled air with high kinetic energy is directed into the turbine 7 with a radial axis, connected to the electric generator 6. On the rotor of the radial-axial turbine 7 with the electric generator 6, the kinetic energy of the cooled air stream is converted into the mechanical work of shaft rotation, resulting in a decrease in the air velocity and the generation of electrical energy. The turbine 7 with a radial axis with an electric generator 6 is selected based on requirements involving the technical properties of the refrigeration unit with dynamic air cooling. Behind the turbine 7, the stream of the air with a low velocity being cooled is directed into the pipe-plate heat exchanger 8, in which the process fluid which is to be cooled down circulates moved by the pump 9. The electrical energy generated by the generator 6 passes through the inverter 10, in which frequency conversion and synchronisation with the mains power supply take place, upon which it is transmitted to the electrical mains, which provides high energy efficiency of the device.

Figure 2:
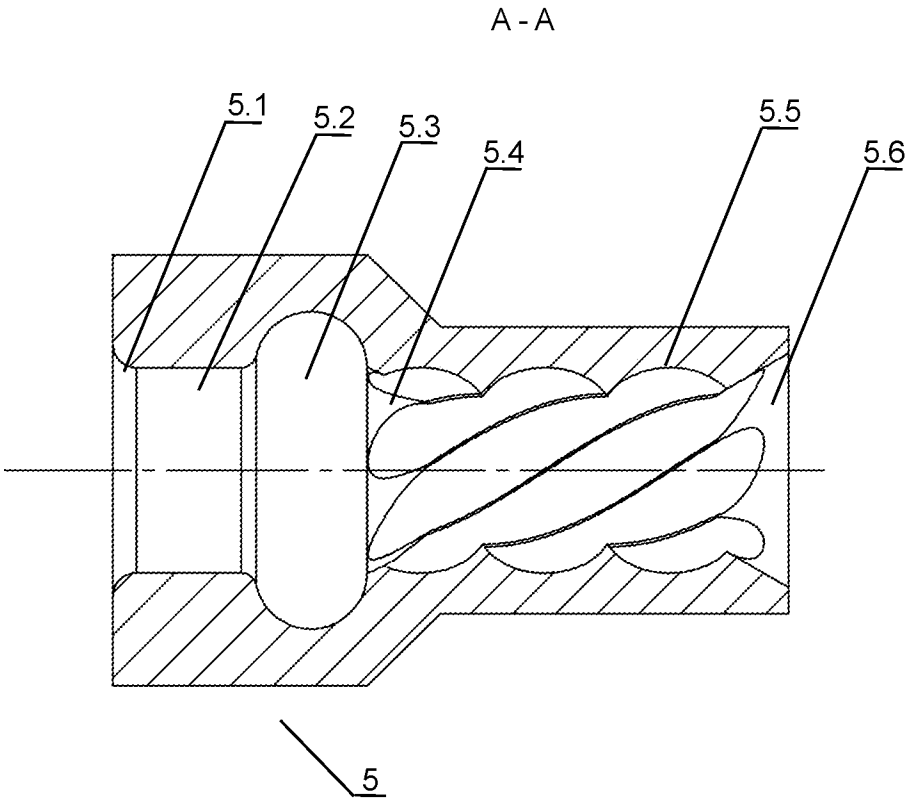
FIG. 2 presents a lengthwise cross-section of the working element of the unit.
Figure 3:
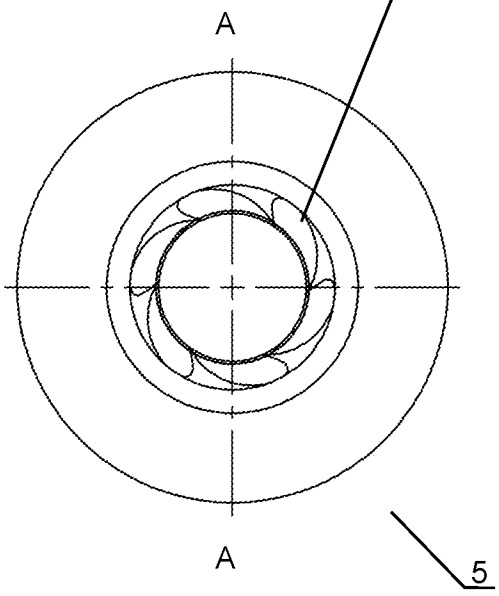
FIG. 3 presents a transverse cross-section of the working element of the unit.

The working element 5 is presented in FIG. 2 and FIG. 3. The shape of the working element 5 enables the flow of air through its interior, setting it into a rotational motion similar to a tornado effect. In this element, the internal (thermal) energy of the air is converted into kinetic energy of the flowing air, which results in an increase in its velocity and a decrease in its temperature.

The working element 5 has a circular inlet 5.1 adjusted to the outlet of the pipe-plate heat exchanger 3. Behind the inlet, there is a cylindrical segment 5.2 with a length substantially shorter than the diameter of the clearance of its opening. Behind the segment 5.2, there is a protuberance 5.3 whose walls are convex towards the outside and they have a semi-circular shape. The diameter of the protuberance 5.3 is larger than the diameter of the cylindrical segment 5.2. Behind the protuberance 5.3, there is a substantially longest segment 5.4 which sets the air into a swirling motion with a turbulent flow. The segment 5.4 is shaped in such a manner that its external walls have recesses 5.5 with shapes resembling oval, which extend obliquely (helically) along its lengthwise cross-section. The recesses 5.5 resemble the rifling of a gun barrel. The cross-section of the recesses 5.5 is not uniform along this part of the working element 5. The size of this cross-section increases and decreases in a fluid manner. The working element 5 ends with an outlet 5.6 with obliquely (conically) shaped walls, where a larger diameter is placed at the end of the element. The outlet 5.6 of the working element is directed towards the turbine 7. In the present example, the working element 5 has 6 recesses 5.5 distributed uniformly along its internal periphery.

The dynamic air cooling, based on which the present invention has been created, is based on the following principles of physics: the first law of thermodynamics; the mechanics of continuous media; Bernoulli's principle; the utilisation of the process of adiabatic air expansion; the phenomenon of an abnormally high increase in draught in the process of discharging gas by means of a pulsed active stream; the utilisation of the Joule-Thomson effect.

An original mathematical model of the dynamic air cooling process was developed based on general theoretical research. The mathematical model enabled the performance of calculations necessary to construct a dynamic air cooling generator.

The cooling process occurs through partial conversion of inner thermal energy of air flow into kinetic energy.

The conversion proceeds based on stream and vertex processes, controlled by the structure of the working element.

The angular and radial air velocity in the working element is calculated based on parameter S (Gupta, A. Turbulent flows [Text]/A. Gupta, D. Lilly, N. Sayred. -M.: Mir, 1987.—588 p.), which is a dimensionless coefficient:

$$S = \frac{\int_0^r \rho V W r^2 dr}{\int_0^r \rho W^2 r dr r}$$

where ρ is the density of the air stream; V is the radial velocity and W is the axial air flow rate. The working element is developed based on a mathematical model with the verification of all parameters on virtual and physical models and, when necessary, the adjustment of these parameters in order to produce the desired results.

The thermophysical parameters of one of the embodiments of the invention obtained by mathematical modelling and visualisation, verified in the CFD software suite, show that: if the air temperature at the input of the channel of the working element 5 is 323 K or +50° C., then the air temperature at the output of the channel of the working element 5 will be about 253 K or −20° C. In such a case, the air flow rate will increase from 40 m/s to 375 m/s.

The theory of the process, as well as information regarding mathematical modelling and design calculations, are presented in the following publications:

1. Abramowicz, G. N. Applied gas dynamics. O 2 h. Part 1: handbook. instructions for technical schools.—Edition five, revised and supplemented. /G. N. Abramowicz. -M Nauka, 1991.—600 p.
2. Maake, V., Eckert, G.-J., Koshpen J.-L. Guidebook on cooling [Text]. -M.: Moscow University Publishing House, 1998.—1142 p.
3. Baklastov, A. N. Processes and industrial installations for exchanging heat and mass.—Energoizdat, 2006.

INDUSTRIAL APPLICABILITY

The refrigeration unit with dynamic air cooling can be mass-produced; it can have varying power depending on the user's needs. The unit is applicable to the cooling technique.

The embodiment of the invention in which an exclusive property or privilege is claimed is defined as follows:

1. A refrigeration unit with dynamic air cooling, comprising:

a centrifugal compressor with an electric drive, a working element providing dynamic air cooling, a turbine with a radial axis, an electrical energy generator, a turbine heat exchanger, a pump of process fluid, a compressor heat exchanger of an air-air type with a fan connected thereto, wherein an outlet of centrifugal compressor is connected to the compressor heat exchanger, an outlet of the compressor heat exchanger is connected to the working element, in turn an outlet of the working element is connected to an inlet of the turbine with a radial axis, connected to the electrical energy generator, while an outlet of the turbine is directed towards the turbine heat exchanger further connected to the pump of the process fluid, said working element having a cylindrical hollow profile comprising helical recesses with a substantially oval shape and configured to provide air cooling by conversion of inner thermal energy of an air flow into kinetic energy.

2. The unit according to claim 1, further comprising an inverter being connected to the generator of the turbine, configured to provide frequency conversion and synchronization of mains power supply.

3. The unit according to claim 2, wherein the inverter is connected to the electric drive of the centrifugal compressor.

4. A working element for a refrigeration unit comprising a centrifugal air compressor, comprising:

a circular inlet;

a cylindrical segment in fluid communication with the circular inlet with a length substantially shorter than a diameter of a clearance of its opening;

a protuberance in fluid communication with the cylindrical segment, having walls which are convex towards outside and they have a semi-circular shape, the diameter of the protuberance being larger than the diameter of the cylindrical segment behind the protuberance;

a substantially longest segment in fluid communication with the protuberance shaped in such a manner that its internal walls have peripheral recesses with shapes resembling oval, which extend helically along its lengthwise cross- section, a cross-section of the recesses not being uniform along this part of the working element and sizes of this cross-section increasing and decreasing in a fluid manner;

an outlet in fluid communication with the longest segment with obliquely shaped walls, where a larger diameter is placed at one end of the working element; the recesses become reduced to an area of the outlet, thereby in the working element internal thermal energy of the air is converted into kinetic energy of flowing air, which results in an increase in its velocity and a decrease in its temperature.

5. A refrigeration unit, comprising:

a centrifugal compressor with an electric drive, a working element providing air cooling, a turbine, an electrical energy generator, a tube-plate heat exchanger, a pump, an air-air tube-plate exchanger of air-air type with a fan connected thereto, wherein an outlet of centrifugal compressor is connected to the tube-plate exchanger, an outlet of the tube-plate pipe-wall exchanger is connected to the working element, whose outlet is connected to an inlet of the turbine, connected to the electrical energy generator, the outlet of the turbine is directed towards the tube-plate heat exchanger further connected to the pump, said working element having a cylindrical hollow profile configured to provide air cooling by conversion of inner thermal energy.

6. The refrigeration unit of claim 5, wherein said compressor working element is adapted to provide a dynamic air cooling.

7. The refrigeration unit of claim 5, wherein the turbine inlet comprises a central axis.

8. The refrigeration unit of claim 5, wherein said cylindrical working element further comprises helical recesses.

9. The refrigeration unit of claim 8, wherein said helical recesses comprise a substantially oval shape.

10. The refrigeration unit of claim 9, wherein said cooling is provided by conversion of inner thermal energy of an air flow into kinetic energy.

* * * * *